US007329098B2

(12) United States Patent
Burdgick

(10) Patent No.: US 7,329,098 B2
(45) Date of Patent: Feb. 12, 2008

(54) ADJUSTABLE SUPPORT BAR WITH ADJUSTABLE SHIM DESIGN FOR STEAM TURBINE DIAPHRAGMS

(75) Inventor: Steven Sebastian Burdgick, Schenectady, NY (US)

(73) Assignee: Geenral Electric Company, Schenectady, NY (US)

( * ) Notice: Subject to any disclaimer, the term of this patent is extended or adjusted under 35 U.S.C. 154(b) by 181 days.

(21) Appl. No.: 11/123,074

(22) Filed: May 6, 2005

(65) Prior Publication Data

US 2006/0251514 A1 Nov. 9, 2006

(51) Int. Cl.
*F01D 25/28* (2006.01)

(52) U.S. Cl. ..... 415/213.1

(58) Field of Classification Search ..... 415/126, 415/209.2, 213.1, 214.1
See application file for complete search history.

(56) References Cited

U.S. PATENT DOCUMENTS

| | | | | |
|---|---|---|---|---|
| 3,408,045 | A * | 10/1968 | Hart | 415/103 |
| 3,544,233 | A * | 12/1970 | Brown et al. | 415/126 |
| 3,860,359 | A * | 1/1975 | De Feo | 415/208.2 |
| 3,970,318 | A | 7/1976 | Tuley | |
| 5,509,780 | A | 4/1996 | Synfelt | |
| 6,325,596 | B1 | 12/2001 | Tomko | |
| 6,352,405 | B1 * | 3/2002 | Tomko | 415/209.2 |
| 6,382,632 | B1 | 5/2002 | Chupp et al. | |
| 6,402,157 | B1 | 6/2002 | Zhou et al. | |
| 6,695,316 | B2 * | 2/2004 | Popa et al. | 277/411 |

FOREIGN PATENT DOCUMENTS

| | | |
|---|---|---|
| EP | 1180581 | 2/2002 |
| GB | 1123886 | 8/1968 |
| GB | 2365077 | 2/2002 |
| JP | 58-106103 | 6/1983 |
| JP | 59-170404 | 9/1984 |

OTHER PUBLICATIONS

English Abstract of Japanese Publication No. JP 59-170404, published Sep. 26, 1984.
English Abstract of Japanese Publication No. JP 58-106103, published Jun. 24, 1983.
English Search Report No. GB 0608840.5 by Examiner A. Swaffer on Aug. 24, 2006, in Great Britain.

* cited by examiner

*Primary Examiner*—Edward K. Look
*Assistant Examiner*—Devin Hanan
(74) *Attorney, Agent, or Firm*—Nixon & Vanderhye, PC

(57) ABSTRACT

A support arrangement for a turbine diaphragm segment in a split turbine casing includes a semi-annular diaphragm segment having a horizontal joint surface; a support bar joined to the diaphragm segment adjacent the horizontal joint surface, the support bar formed with a first flange extending outwardly over a portion of the casing, the portion including a horizontal surface; and a shim on the horizontal surface and engaged by the first flange.

18 Claims, 4 Drawing Sheets

ADJUSTABLE SUPPORT BAR WITH ADJUSTABLE SHIM DESIGN FOR STEAM TURBINE DIAPHRAGMS

BACKGROUND OF THE INVENTION

This invention relates to power generating steam turbines generally, and, more specifically, to support arrangements for diaphragms within the steam turbine casing.

A typical double-flow, low pressure (LP) steam turbine includes a pair of LP rotor sections surrounded, respectively, by diaphragms, each of which is comprised of a pair of semi-annular diaphragm ring segments that are joined at horizontal joints, spaced 180° from each other. Each ring segment supports a plurality of static nozzles that direct flow into the rotating buckets on axially spaced rotor wheels. The diaphragms are typically located axially between the rows of buckets and are typically supported vertically by any of several known methods. These include support bars, pins or support screws. Each design has its own advantages and disadvantages.

Support bars, for example, currently require that the diaphragm be installed before measurement. After the required measurements are recorded, the diaphragm and rotor are removed so the support bar can be machined to adjust the vertical position of the diaphragm. The sequence is then repeated as necessary to verify the diaphragm position. In addition, current diaphragm adjustment requires removal of both the diaphragm and the rotor as well as bolted-in shims, and can thus take several shifts or days to adjust.

Current support screw designs can only be used on the smaller HP stages because the weight of IP and LP stages is too great. One drawback to the use of support screws is that there is insufficient surface area in the diaphragm cross section to allow for bolting of the upper half diaphragm to the lower half diaphragm. This non-bolted configuration creates a gap between the half-sections at the horizontal split or joint line, causing turbine efficiency losses.

Support pins are generally used in LP turbines, but they cannot support as much weight as support bar designs.

Accordingly, there remains a need for an easily accessible support arrangement that facilitates vertical adjustment of the diaphragm ring segment in a relatively quick and efficient manner.

BRIEF DESCRIPTION OF THE INVENTION

In an exemplary embodiment of this invention, a new support bar arrangement permits selectively quick adjustments through the utilization of shims that can be removed with only a small vertical lift of the diaphragm ring segment. More specifically, the support bar is formed with an outwardly directed flange that overlies a support surface on the turbine casing. The support surface may be formed with a shallow pocket in which one or more shims are seated. On assembly, the shim(s) is (are) engaged by the outwardly directed flange of the support bar.

The support bar is also formed with a second, inwardly directed flange that is received in a slot formed in the diaphragm segment, adjacent the horizontal joint or split surface. The arrangement is such that the support surface of the first outwardly extending flange of the support bar is substantially flush with the horizontal joint surface of the diaphragm segment. In the disclosed embodiment, one or more bolts are used to secure the support bar to the diaphragm segment. It will be appreciated that a similar support bar is employed on the opposite side of the diaphragm segment.

To adjust the diaphragm segment position after installation, it is necessary only to lift the diaphragm segment in a vertical direction a distance that will allow removal and/or replacement of the shims from the pockets in the casing support surfaces.

Accordingly, in its broader aspects, the invention relates to a support arrangement for a turbine diaphragm segment in a split turbine casing comprising a semi-annular diaphragm segment having a horizontal joint surface; a support bar joined to the diaphragm segment adjacent the horizontal joint surface, the support bar formed with a first flange extending outwardly over a portion of the casing, the portion including a horizontal surface; and a shim on the horizontal surface and engaged by the first flange.

In another aspect, the invention relates to a support arrangement for a turbine diaphragm segment in a split turbine casing comprising a semi-annular diaphragm segment having a horizontal joint surface; a support bar joined to the diaphragm segment adjacent the horizontal joint surface, the support bar formed with a first flange extending outwardly over a cut-out area of the casing, the cut-out area defined by a vertical wall and a horizontal surface, and a second flange extending inwardly and seated in a slot formed in the diaphragm segment; and at least one shim seated on the horizontal surface, and engaged by the first flange.

In still another aspect, the invention relates to a support arrangement for a lower turbine diaphragm segment in a lower turbine casing comprising a semi-annular diaphragm segment having a pair of horizontal joint surfaces, spaced circumferentially 180° from each other; a support bar joined to the diaphragm segment adjacent each of the horizontal joint surfaces, each support bar formed with a first flange extending outwardly over a portion of the casing, the portion including a horizontal surface; and a shim located on the horizontal surface and engaged by the first flange.

The invention will now be described in detail in connection with the drawings identified below.

DETAILED DESCRIPTION OF THE INVENTION

Figure 1:
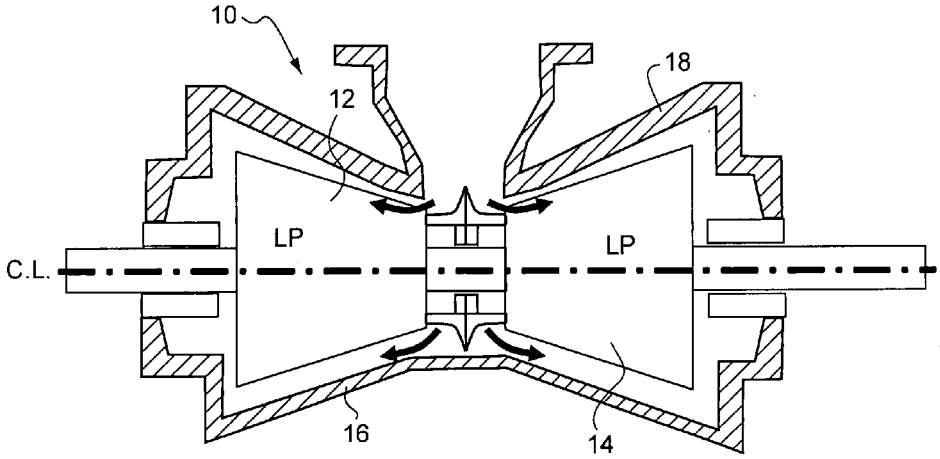
Fig. 1 (Prior Art)
FIG. 1 is a cross section, in partially schematic form, illustrating a conventional double flow, low pressure steam turbine.

FIG. 1 illustrates a conventional double-flow, low pressure (LP) steam turbine 10 that includes first and second low pressure (LP) turbine sections 12, 14 surrounded by diaphragm assemblies 16, 18, respectively.

Figure 2:
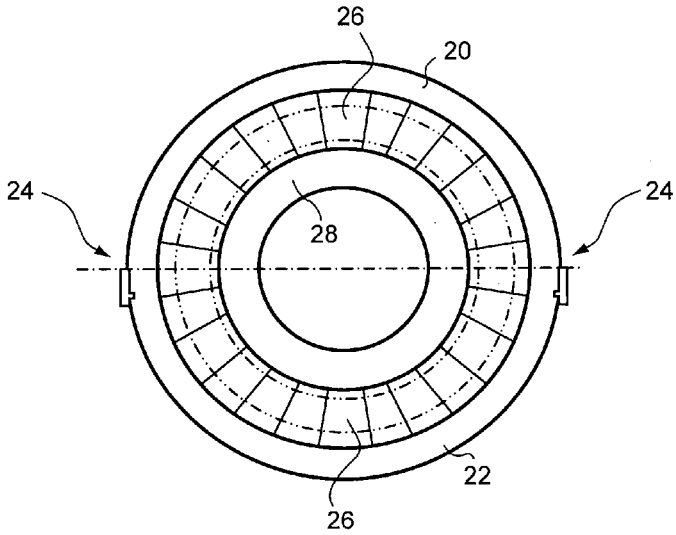
Fig. 2 (Prior Art)
FIG. 2 is a generally schematic end elevation of a pair of annular diaphragm ring segments joined at a horizontal split surface.

Each diaphragm is composed of a pair of semi-annular diaphragm ring segments 20, 22 (FIG. 2) joined at a horizontal split or joint surfaces 24. Each diaphragm segment supports a semi-annular row of nozzles 26 and an inner web 28.

Figure 3:
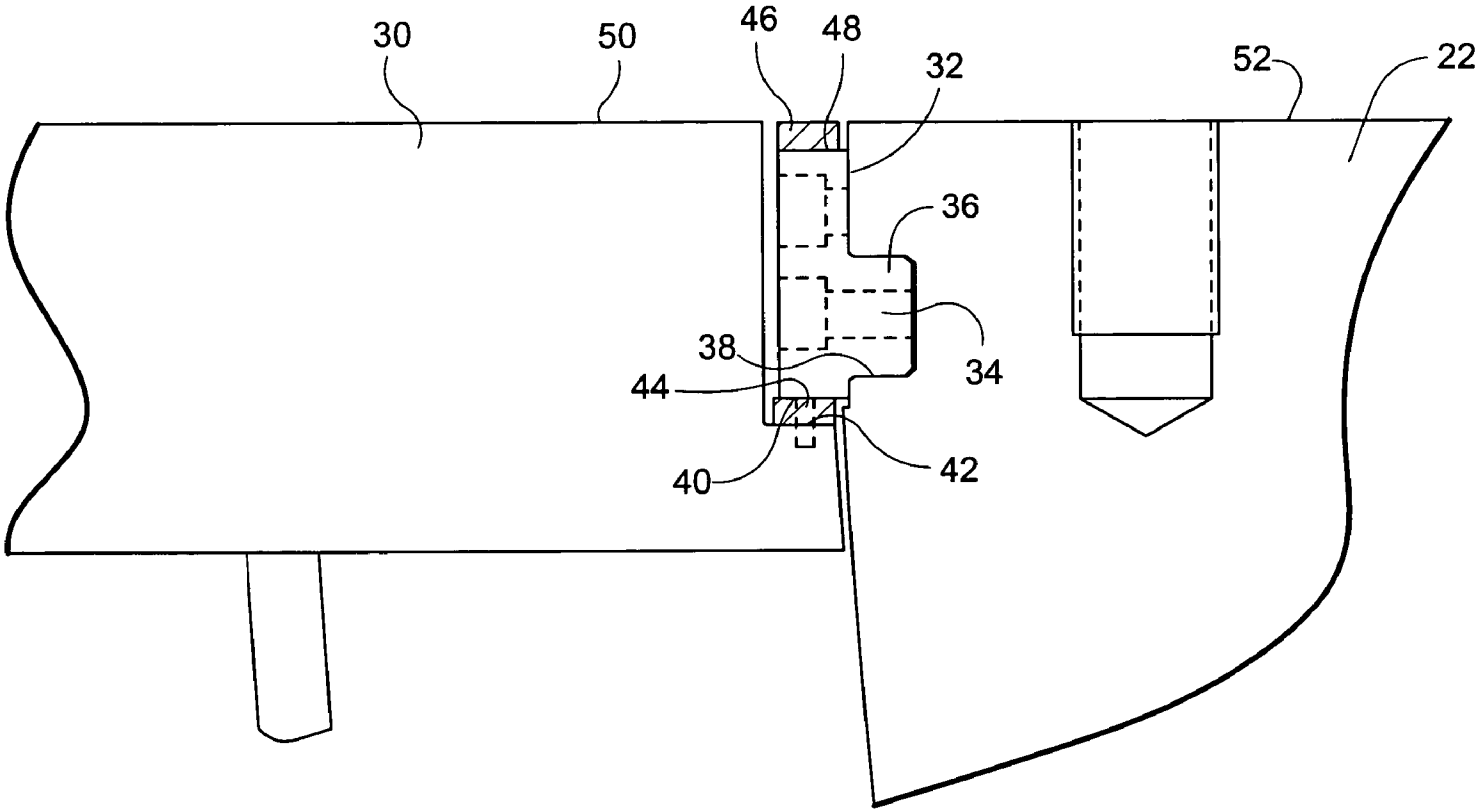
Fig. 3 (Prior Art)
FIG. 3 is a partial end elevation of a conventional diaphragm support bar attached to a lower diaphragm ring segment.

With reference now to FIG. 3, the lower diaphragm ring segment 22 is shown to be vertically supported within a turbine casing half (or simply, casing) 30 by a support bar 32 bolted to the diaphragm segment 22 by bolt(s) 34 extending through the support bar, and specifically through an inwardly directed flange 36 of the support bar that is received in a mating slot 38 in the lower diaphragm segment. The support bar otherwise extends vertically along the casing 30 on one side and the diaphragm segment 22 on the other side. The lower surface 40 of the support bar faces a shoulder 42 formed in the casing 30, with a shim block 44 interposed between the shoulder 42 and the lower surface 40 and typically bolted to the casing 30. A second shim block 46 is shown seated on the upper surface 48 of the support bar to effectively make the upper end of the support bar flush with the horizontal joint surfaces 50, 52 of the casing and diaphragm half, respectively, enabling the support bar 32 to be sandwiched between the upper and lower casing sections. The other side of the lower diaphragm segment 22 is similarly supported at the opposite side of the casing.

Figure 4:
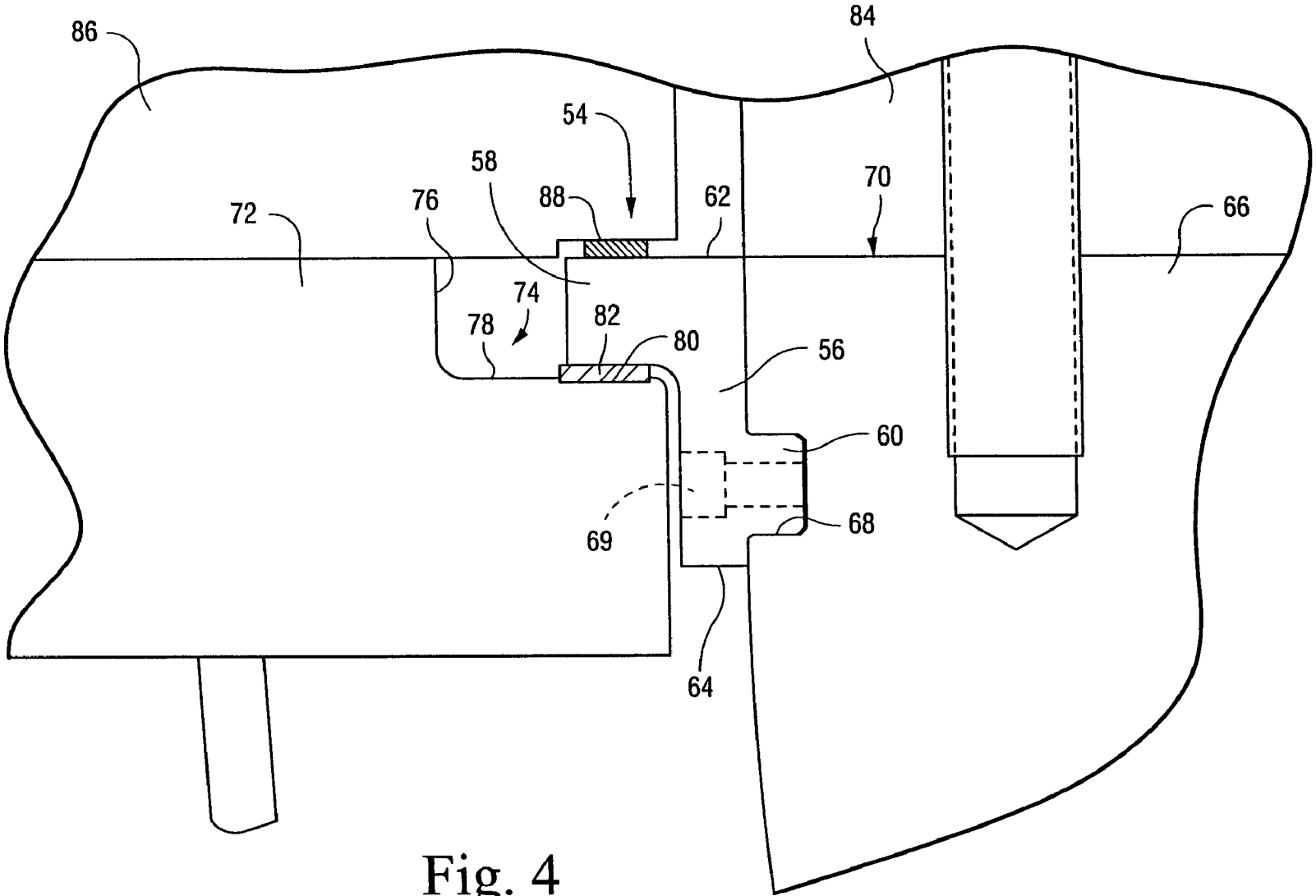
FIG. 4 is a partial end elevation of a support bar attached to a lower diaphragm segment in accordance with an exemplary embodiment of the invention.
Figure 5:
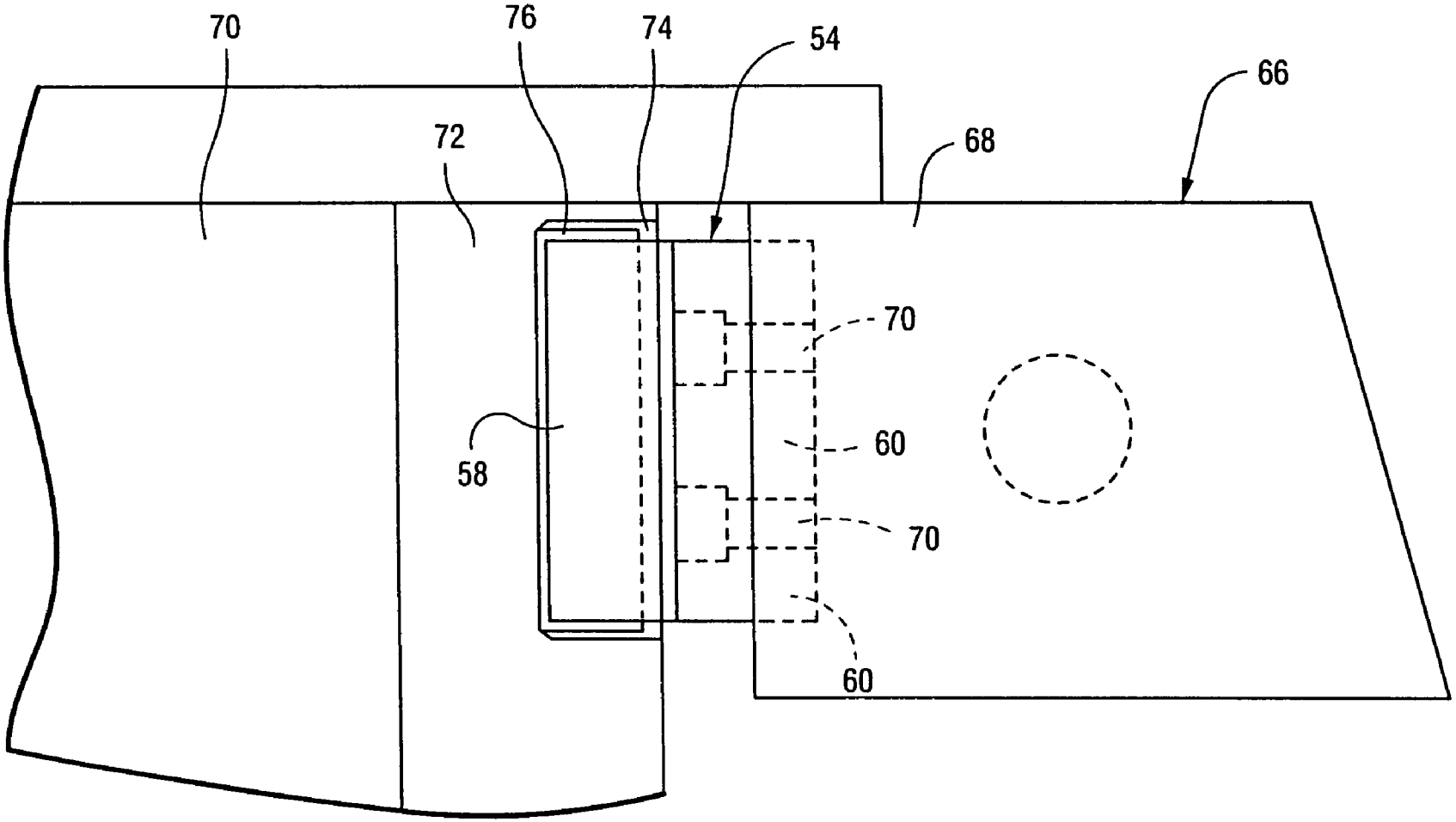
FIG. 5 is a partial plan view of the support bar illustrated in FIG. 4.

FIGS. 4 and 5 illustrate a newly designed support bar 54 in accordance with an exemplary embodiment of this invention. The support bar is formed with a center body portion 56 and a pair of oppositely extending flanges 58, 60. The first or outwardly extending flange 58 is located at the upper end of the center body portion 56, creating a flat top surface 62. The second or inwardly directed flange 60 is located adjacent the lower end of the center body portion 56 but spaced upwardly from the bottom surface 64.

The support bar 54 is attached to the lower diaphragm segment 66. In this regard, the lower diaphragm segment 66 is formed with an outwardly facing slot 68 that receives the inwardly directed flange 60, with bolts 69 extending laterally through the center body portion 56 and flange 60 into the diaphragm segment 66. The support bar 54 is sized and shaped such that when attached, the top surface 62 of the support bar is substantially flush with the horizontal joint or split surface 70 of the lower diaphragm segment.

The lower turbine casing 72 is formed with a cutout area 74 that includes a vertical wall 76 and a horizontal shoulder or surface 78, a portion of which underlies the outwardly extending flange 58 of the support bar 54. The shoulder 78 is formed with a shallow pocket 80 that is shaped to receive and at least partially enclose a shim 82. The shim 82 may be a single block, or a stacked array of thin (0.001-0.005 in.) discrete shim elements. Thus, when the diaphragm segment 66 is located within the lower turbine casing 72, it is vertically supported by the outwardly directed flange 58 engaged indirectly with the casing shoulder 78, with shim 82 interposed therebetween. It will be appreciated that a similar support bar is employed on the other side of the diaphragm segment, along the horizontal joint or split line.

Note also that when the upper diaphragm segment 84 and upper casing 86 are installed, a portion of the upper casing 86 overlies the support bar, with a shim 88 interposed therebetween, to prevent any vertical movement of the diaphragm assembly in operation.

With the above arrangements, adjustment of the vertical position of the diaphragm segment 66 in the lower casing 72 can be achieved with reduced downtime. It is only necessary to raise the lower diaphragm segment 66 an amount sufficient to allow removal of the shim 82 from the pocket 80 so that the shim 82 can be removed and a differently-sized shim located in the pocket 80. Alternatively, shim 82 may be in the form of a stacked array of shim elements, such that the upper shim (or more) can be simply "peeled off" the stack to adjust the vertical position of the diaphragm.

In an alternative arrangement, the shim 82 could be extended laterally into the cutout area 74 and bolted to the casing shoulder 76. This arrangement would eliminate the need for the pocket 80 while, at the same time, providing easy access to the bolt used to secure the shim. Moreover, no additional lifting of the diaphragm is necessary to slide the shim out from under the support bar flange 58.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A support arrangement for a turbine diaphragm segment in a split turbine casing comprising:

a semi-annular diaphragm segment having a horizontal joint surface;

a support bar joined to said diaphragm segment adjacent said horizontal joint surface, said support bar formed with a center body portion and a first flange extending perpendicular to said center body portion and radially outwardly over a portion of the casing, said portion including a horizontal surface; and a shim on said horizontal surface and engaged by a lower surface of said first flange, an upper surface of said first flange being substantially flush with said horizontal joint surface.

2. The support arrangement of claim 1 wherein said support bar is formed with a second flange extending perpendicular to said center body portion and radially inwardly and seated in a slot formed in said diaphragm segment.

3. The support arrangement of claim 2 wherein one or more bolts extend through said second flange and into said diaphragm segment.

4. The support arrangement of claim 2 wherein said horizontal surface is formed with a shallow pocket with said shim seated in said pocket.

5. The support arrangement of claim 1 wherein said portion of said casing comprises a cut-out area, said horizontal surface forming a base of said cutout area.

6. The support arrangement of claim 1 wherein said shim comprises a shim pack with plural stacked shim elements.

7. A support arrangement for a turbine diaphragm segment in a split turbine casing comprising:

a semi-annular diaphragm segment having a horizontal joint surface;

a support bar joined to said diaphragm segment adjacent said horizontal joint surface, said support bar formed with a first flange extending outwardly over a portion of the casing, said portion including a horizontal surface; and a shim on said horizontal surface and engaged by said first flange wherein said horizontal surface is formed with a shallow pocket with said shim seated in said pocket.

8. The support arrangement of claim 7 wherein said pocket surrounds said shim on at least three sides thereof.

9. The support arrangement of claim 8 wherein said pocket surrounds said shim on four sides thereof.

10. A support arrangement for a turbine diaphragm segment in a split turbine casing comprising:

a semi-annular diaphragm segment having a horizontal joint surface;

a support bar joined to said diaphragm segment adjacent said horizontal joint surface, said support bar formed with a vertically-oriented center body portion, with a first flange extending perpendicular to said center body portion and radially outwardly over a cut-out area of the casing such that an upper surface of said first flange is substantially flush with said horizontal joint surface, said cut-out area defined by a vertical wall and a horizontal surface, said support bar formed with a second flange extending perpendicular to said center body portion and radially inwardly and seated in a slot formed in said diaphragm segment; and at least one shim seated on said horizontal surface, and engaged by said first flange.

11. The support arrangement of claim 10 wherein one or more bolts extend through said second flange and into said diaphragm segment.

12. The support arrangement of claim 10 wherein said at least one shim comprises a shim pack with plural stacked discrete shim elements.

13. The support arrangement of claim 10 wherein said horizontal surface is formed with a shallow pocket with said shim seated in said pocket.

14. A support arrangement for a lower turbine diaphragm segment in a lower turbine casing comprising:

a semi-annular diaphragm segment having a pair of horizontal joint surfaces, spaced circumferentially 180° from each other;

a support bar joined to said diaphragm segment adjacent each of said horizontal joint surfaces, each support bar formed with a first flange extending outwardly over a portion of the casing, said portion including a horizontal surface;

a shim located on said horizontal surface and engaged by said first flange, wherein said horizontal surface is formed with a shallow pocket with said shim seated in said pocket;

further comprising an upper turbine casing that at least partially overlies each said support bar; and wherein a shim is interposed between and engaged with said upper casing and each said support bar.

15. The support arrangement of claim 14 wherein said pocket surrounds said shim on at least three sides thereof.

16. The support arrangement of claim 15 wherein said pocket surrounds said shim on four sides thereof.

17. The support arrangement of claim 14 and further comprising an upper turbine casing that at least partially overlies each said support bar.

18. The support arrangement of claim 14 wherein a shim is interposed between and engaged with said upper casing and each said support bar.

* * * * *